US006728988B2

(12) United States Patent
Chaffee et al.

(10) Patent No.: US 6,728,988 B2
(45) Date of Patent: May 4, 2004

(54) BALL COLLECTOR FOR CLEANING SYSTEMS USED FOR FLUID CONDUCTING TUBING

(76) Inventors: Lynn Chaffee, 1608-16th St., Racine, WI (US) 53403; Terry Loper, 1608-16th St., Racine, WI (US) 53403

( * ) Notice: Subject to any disclaimer, the term of this patent is extended or adjusted under 35 U.S.C. 154(b) by 164 days.

(21) Appl. No.: 10/013,047

(22) Filed: Dec. 7, 2001

(65) Prior Publication Data

US 2002/0083537 A1 Jul. 4, 2002

Related U.S. Application Data

(60) Provisional application No. 60/251,806, filed on Dec. 8, 2000.

(51) Int. Cl.[7] ..... B08B 9/055

(52) U.S. Cl. ..... 15/3.51; 165/95; 210/95; 210/446

(58) Field of Search ..... 15/3.5, 3.51, 104.062; 137/550; 165/95; 210/95, 446, 447, 459

(56) References Cited

U.S. PATENT DOCUMENTS

| | | | | | |
|---|---|---|---|---|---|
| 551,044 | A | * | 12/1895 | Park | 210/447 |
| 2,552,744 | A | * | 5/1951 | Smith | 210/447 |
| 2,915,188 | A | * | 12/1959 | Buker | 210/447 |
| 3,215,195 | A | * | 11/1965 | Treplin | 165/95 |
| 4,016,621 | A | * | 4/1977 | Slegers et al. | 15/104.062 |
| 4,476,021 | A | * | 10/1984 | Souza | 210/446 X |
| 5,010,950 | A | * | 4/1991 | Voith | 165/95 |
| 5,592,990 | A | * | 1/1997 | Ben-Dosa | 165/95 |

* cited by examiner

*Primary Examiner*—Mark Spisich
(74) *Attorney, Agent, or Firm*—Ronald Brockman

(57) ABSTRACT

In a cleaning system which uses balls made of spongy material for cleaning fluid conducting tubing a ball collector having a housing with inlet and outlet ports, the outlet port having a strainer screen which allows fluid but not the balls to pass, and an access port with a releasable cover sealed with an O-ring. The cover is of metal frame construction with a transparent center, preferably preferably comprised of a pyrex glass member encased in a metal sleeve.

4 Claims, 2 Drawing Sheets

BALL COLLECTOR FOR CLEANING SYSTEMS USED FOR FLUID CONDUCTING TUBING

CROSS REFERENCE

Provisional Patent application 60/251,806, filed Dec. 8, 2000.

BACKGROUND OF THE INVENTION

This invention relates to cleaning systems which use balls made up of spongy material for cleaning fluid conducting tubing. More specifically it relates to ball collectors in the cleaning systems which includes balls made up of spongy material, the balls having a diameter which is slightly larger than the diameter of the tubing. The ball collector is comprised of a cylindrical housing which has inlet and outlet ports, the latter containing a strainer screen which retains the balls while allowing the fluid to pass through, thereby trapping the balls within the housing, and an access port for retrieving the balls, the access having a removal cover which is transparent. This allows the viewing of the interior of the housing to determine whether any cleaning balls have been trapped within the housing without removing the cover.

OBJECTS OF THE INVENTION

This invention relates to cleaning systems which use balls made of spongy material for cleaning fluid conducting tubing. It consists of a ball collector having a housing with inlet and outlet ports, the outlet port having a strainer screen which allows fluid but not the balls to pass, and an access port with a releasable cover. The cover is transparent, preferably having a pyrex glass member encased in a metal sleeve.

An object of the invention is to provide a ball collector for collecting spongy cleaning balls used in cleaning fluid conducting tubing. More specifically, an object is to provide an improved ball collector with a transparent lid to permit the viewing of the interior of the collector for the presence of sediment and cleaning balls without having to remove the lid.

Another object of this invention is to provide a ball collection for collecting cleaning bodies used in cleaning a tubular fluid conducting systems, which is capable of collecting cleaning cleaning bodies without clogging the outlet opening of the collector with foreign matter even when large amounts of foreign matter is introduced into the collector.

Another object of this invention is to provide for a ball collector which does not leak.

These and other objects will be apparent from the disclosures of this invention.

DETAILED DESCRIPTION OF THE INVENTION

This invention relates to cleaning systems which use balls under fluid pressure to clean fluid conducting tubing. The cleaning system comprises balls (not shown) made up of spongy material with a diameter which is slightly larger than the diameter of the tubing which is being cleaned. The balls are propelled through the tubing by fluid under pressure. The use of these kinds of balls in cleaning systems is well known and need not be described.

Figure 1:
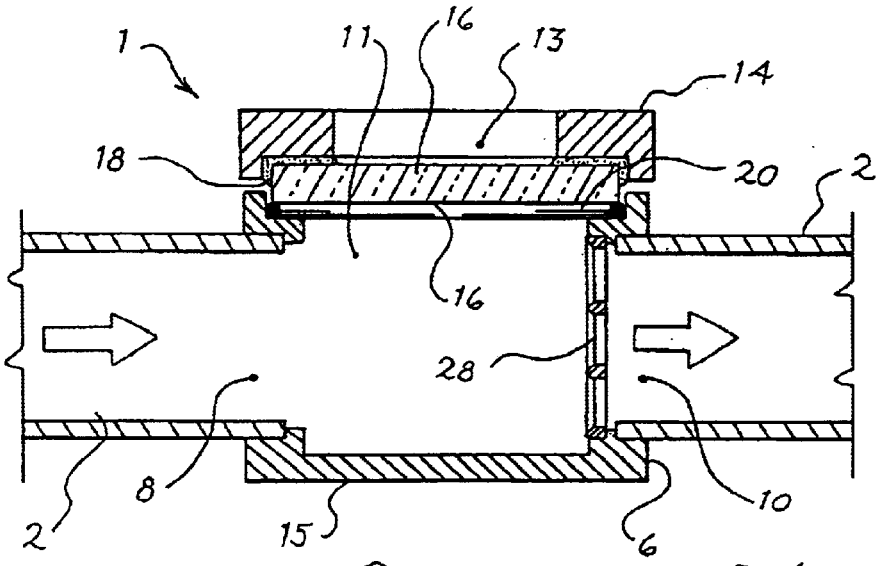
FIG. 1. is a cross sectional schematic side view of the ball collector of this invention in place in a fluid drain line.
Figure 2:
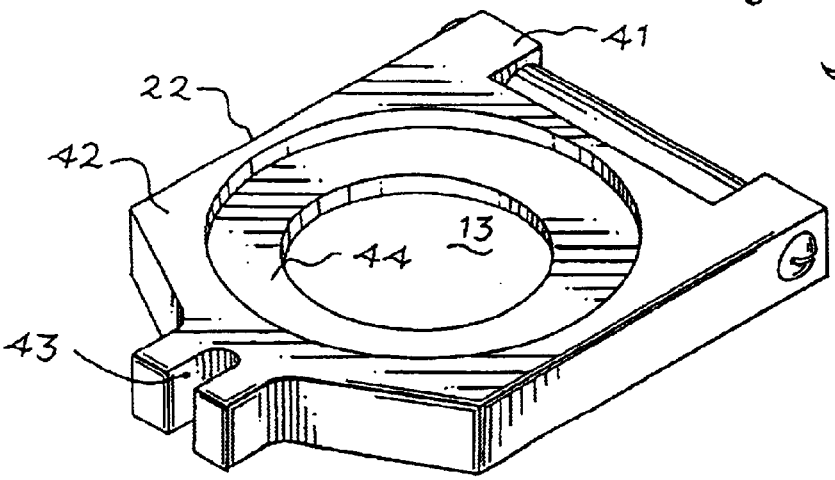
FIG. 2. is a perspective view of the underside of the hinged cover of this invention.
Figure 4:
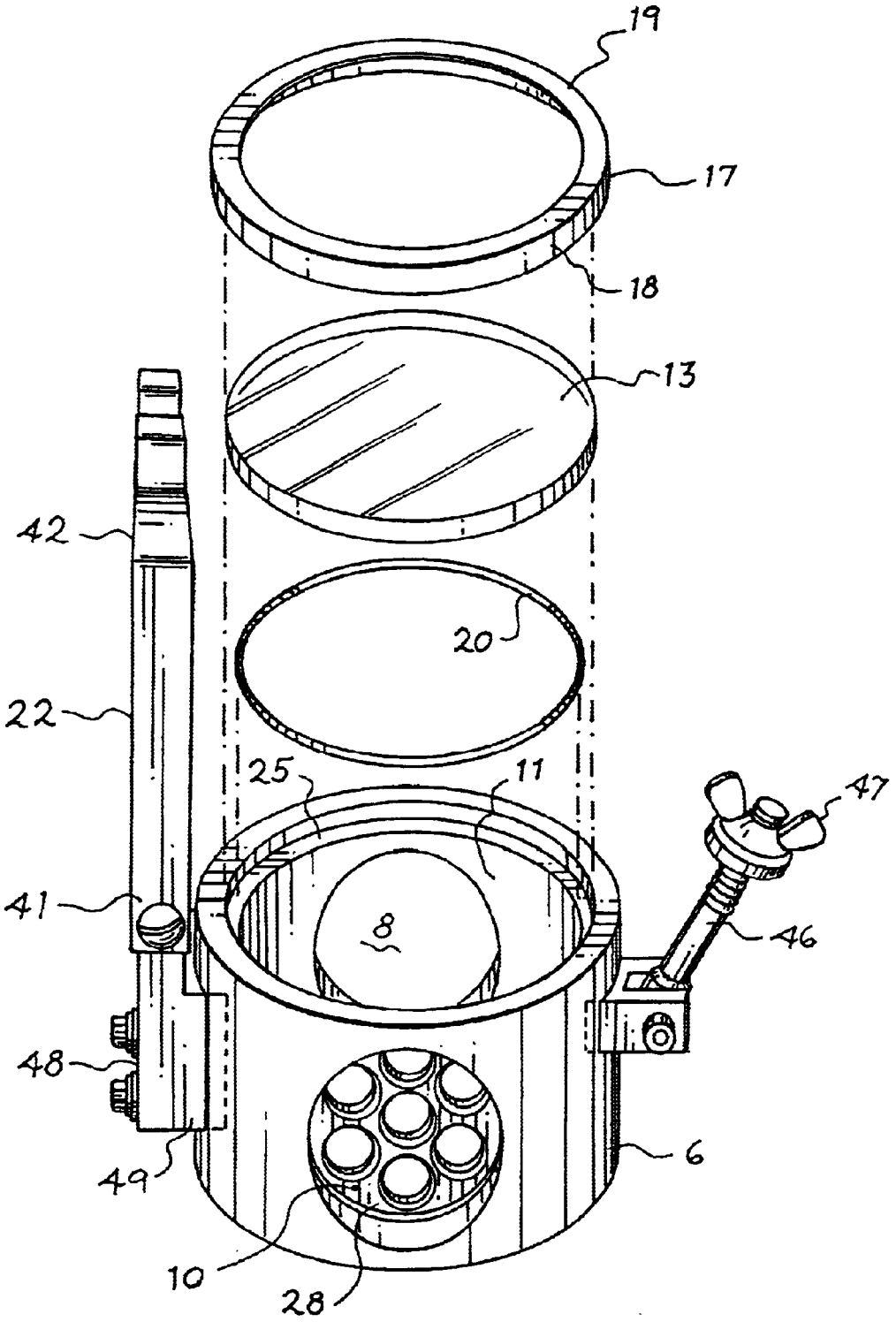
FIG. 4. is a fragmented top perspective view of the ball collector of this invention.

Referring to FIG. 1, which is a schematic representation of this invention, the ball collector 1, which is located in the fluid drain lines 2 of the fluid conducting tubing (not shown), of this invention comprises a cylindrical housing 6 which has a bottom 15, an inlet port 8, an outlet port 10 with a strainer screen 28 and an access port 11 which is covered by a lid 14. The arrows in FIG. 1 indicate the direction of flow of cleaning fluid in operation. Referring to FIG. 2 and FIG. 4 the lid 14 comprises a hinged element 22 with a centered access opening 13, and a sleeve element 17 and a transparent cover element 16 encased by the sleeve element 17 and means to attach 48 to the housing 6. The hinged element is countersunk at the periphery of the access opening 13 to form a ledge 44. The transparent cover element 16 and sleeve element 17 are held in place over the access port 11 by countersunk recess of the hinged element 22. The transparent element 16 allows for the viewing of the interior of the housing 6 for the presence of cleaning balls when the lid 14 is locked in place.

Referring to FIG. 2 the hinged cover 22 is substantially rectangular in shape. It is hinged at one side 41 and at the opposite side 42 of the hinged cover 22 is a slot 43 capable of releasably receiving a latch 46 shown in FIG. 4. The latch may be locked in place with a wing nut 47. In a preferred embodiment the cover has an access opening 13. The cover 22 is countersunk on its underside (the side facing the interior of the housing 6) at the periphery of the access opening 13 so as to be capable of receiving the sleeve element 18 with the encased transparent element 16.

Figure 3:
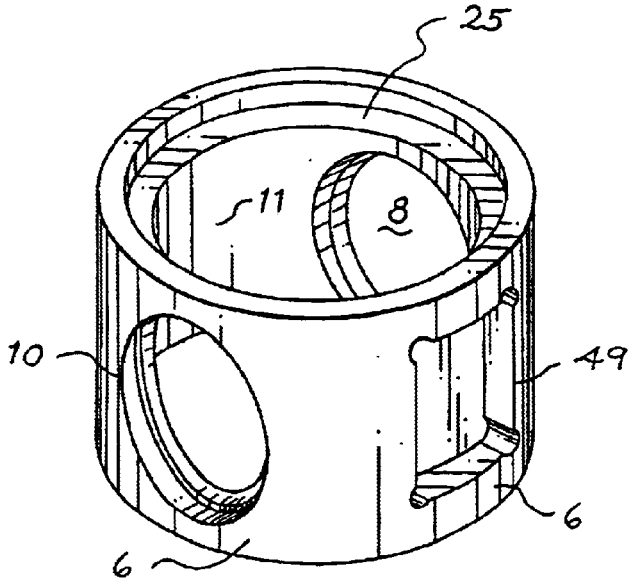
FIG. 3 is a top perspective view of the cylindrical housing of this invention.

Referring to FIGS. 3 and 4 the hinged cover 22 is pivotally attached to the housing 6 by an attachment means 48. The hinged cover 22 has a central opening 13. The transparent element 16 is preferably made of pyrex glass housed and is housed within the sleeve element 17, the sleeve element 17 having a circumferential side wall 18 and an upper lip 19 capable of receiving the transparent element 16. In a preferred embodiment the transparent element 16 is held within the sleeve element 17 by glue, such as silicon glue, which is known in the art. At the access port 11 the housing 6 is countersunk to form a ledge 25. In operation the glass cover element 16 rests on an O-ring 20 which sits on the ledge 25 of the housing 6 to cover the access opening 13. When the hinged cover 22 is engaged it is capable of holding the transparent element 16 with its sleeve 17 in place over the access port 11. A strainer screen 28 capable of allowing fluid to pass, but not cleaning balls (not shown), covers the outlet port 10. The latch 46 is fixedly attached to the housing 6. In another preferred embodiment the latch 46 is seated in a recess 49 in the wall of the cylindrical housing 6. Similarly the hinge 48 of the hinged cover 22 may be seated in a similar recess in the wall of the housing 6 across from the latch recess 49.

While the invention was described with respect to one preferred embodiment, it will be apparent that this is set forth as an example and that many variations, modifications and applications of the invention can be made.

We claim:

1. In a cleaning system for cleaning fluid conducting tubing, which uses balls made up of spongy material, a ball collector comprising:

a cylindrical metallic housing with inside and outside walls, having a sealed bottom, an access port and inlet and outlet ports, the inlet and outlet ports being aligned with each other on opposite sides of the housing and capable of receiving the fluid conducting tubing, the outlet port having a strainer screen, the strainer screen being in and covering the outlet port and capable of allowing fluid to pass while retaining the balls made up of spongy material, a hinged cover for the access port, the hinged cover comprising a metallic frame having a central opening which is covered by a transparent element, the transparent element being encased in a metallic sleeve and being a glass member capable of covering the central opening and having a means to hold the glass member and sleeve in place within the cover, an O-ring capable of forming a seal between the cylindrical housing and the glass element of the hinged cover, a means to attach the hinged cover to the housing, and a means to lock the hinged cover releasably in a closed position.

2. The ball collector of claim 1 wherein the O-ring rests on a countersunk circumferential ledge around the access port of the cylindrical housing, the ledge being capable of receiving the sleeve and encased glass member.

3. The ball collector of claim 2 wherein the means to attach and means to lock the hinged cover are attached to the housing by means of recesses in the outer wall.

4. The ball collector of claim 3 wherein the cylindrical housing is one-quarter to one-half inch thick.

* * * * *